United States Patent [19]

Iida et al.

[11] Patent Number: 5,036,363

[45] Date of Patent: Jul. 30, 1991

[54] METHOD OF TONER DETECTION FOR REPLENISHMENT IN A DEVELOPER

[75] Inventors: Masaru Iida, Kawasaki; Akiyoshi Iwamasa, Ebina; Yoshihiro Tonomoto, Kanagawa, all of Japan

[73] Assignee: Fujitsu Limited, Kawasaki, Japan

[21] Appl. No.: 536,845

[22] Filed: Jun. 12, 1990

[30] Foreign Application Priority Data

Jun. 20, 1989 [JP] Japan ..... 1-157938

[51] Int. Cl.[5] ..... G03G 21/00

[52] U.S. Cl. ..... 355/246; 355/208; 118/689; 118/694

[58] Field of Search ..... 355/208, 246, 245; 118/689, 694

[56] References Cited

U.S. PATENT DOCUMENTS 4,739,365 4/1988 Hino ..... 355/246

FOREIGN PATENT DOCUMENTS 0130366 8/1983 Japan ..... 355/246

*Primary Examiner*—A. T. Grimley

*Assistant Examiner*—Christopher Horgan

*Attorney, Agent, or Firm*—Armstrong, Nikaido, Marmelstein, Kubovcik & Murray

[57] ABSTRACT

A method of detecting toner in the toner supplying unit of a developing unit wherein a toner supplying roller is caused to make a single turn, the duration of a signal indicating "no-existence of toner" issued during this single turn period is accumulated by timer function of a control unit. When a total sum of accumulated signal timer duration is longer than a first preset time, including a constant margin added to the difference between the time required for a single turn of the toner supplying roller and the time required for passing over the toner detecting surface by a cleaning means, the "no-existence of toner" condition is detected for the toner supplying unit. Additionally, the duration of a signal indicating "existence of toner" is accumulated by the timer function of the control unit, and when a total sum of accumulated signal duration longer than a second preset time is required for making a single turn by the toner supplying roller, the "existence of toner" condition is detected for the toner supplying unit.

8 Claims, 6 Drawing Sheets

METHOD OF TONER DETECTION FOR REPLENISHMENT IN A DEVELOPER

BACKGROUND OF THE INVENTION

1. Field of the Invention

The present invention relates particularly to a method of detecting toner in a developing unit for developing a latent image formed on a photosensitive material of an electronic duplicator with the toner.

With progress of an information-oriented society, a variety of printers or copying machines are used widely, wherein a latent image formed on photosensitive material is developed by toner in the printer or duplicator employing the electrophotography system, the developed toner image is transcribed to a recording sheet and this transcribed toner image is fixed for the printing purpose.

This developing unit comprises a toner supplying unit for supplying toner, a stirring unit for obtaining a developer by mixing the toner and magnetic powder material called a carrier and a developing roller for supplying this developer to the photosensitive material to deposit the toner to a latent image.

The toner supplying unit is provided with a toner detector for detecting toner, while the stirring unit is provided with a concentration sensor for detecting toner concentration.

Since the toner is deposited to a latent image on the photosensitive material, the amount of toner at the stirring unit is reduced. When the concentration sensor detects a shortage of toner, the toner supply roller of the toner supplying unit rotates and the toner is supplied to the stirring unit.

Meanwhile, a toner is supplied from the toner cartridge in the toner supplying unit. When the toner in the toner cartridge is consumed completely, the toner detector detects such condition and indicates a need for replacement of the toner cartridge. However, in case the toner is adhered to the detecting surface of the toner detector, the toner detector judges that the toner cartridge is filled with the toner and therefore if the toner is actually in the shortage condition, the toner cartridge is erroneously judged to be filled with the toner.

In view of avoiding such erroneous detection, the detecting surface of the toner detector is usually cleaned by a cleaning means which rotates with rotation of the toner supply roller.

2. Description of the Related Art

FIG. 1 is a diagram for explaining an example of developing unit. The photosensitive drum 1 is rotated in the direction of arrow mark A by a motor $M_1$ and a latent image, for example, of letters is formed on the surface of photosensitive drum 1 by irradiating the surface of photosensitive drum 1 uniformly charged by a precharger 2 with the modulated laser beam 3. This latent image is developed by the developer supplied by the developing roller 7 of the developing unit 4.

The developing unit 4 is formed by the toner supplying unit, stirring unit and developing roller unit and is housed in the housing case 9.

The toner supplying unit comprises a toner cartridge 19, a toner hopper 18 for temporarily holding toner, a toner supplying roller 13 formed by sponge roller to push out the toner from a hole 12, an agitator 14 for stirring the toner, a toner detector 16 providing the detecting surface 15 to detect the toner and a cleaning means 17 for cleaning the detecting surface 15.

The stirring unit comprises a couple of stirring rollers 10, 11 for stirring the toner and the carrier and a concentration sensor 8 for detecting toner concentration.

The developing roller unit comprises a magnet roller 5 for attracting the carrier and a non-magnetic sleeve 6 for supplying such attracted carrier and toner to the surface of photosensitive drum 1.

As shown by the arrow mark B, the non-magnetic sleeve 6 of the developing roller 7 rotates in the inverse direction to a magnet roller 5 and the toner attracted by the carrier which is also attracted by the non-magnetic sleeve 6 is adhered to a latent image on the photosensitive drum 1 by the field formed by the magnet roller 5 and thereafter developing is carried out.

When a recording sheet 21 carried by a couple of feed rollers 20, 22 and a sheet guide 23 comes into contact with the surface of photosensitive drum 1, a developed toner image is transcribed to the recording sheet 21 charged by a charging unit for transcription (not illustrated).

The stirring rollers 10, 11 are respectively rotated in the directions indicated by the arrow marks C and D by the motor $M_2$ in order to stir the carrier and toner. Accordingly, the toner is adhered to the surface of carrier. The toner concentration may be measured by a concentration sensor (permeability sensor) 8 to measure the toner concentration utilizing the property that when a larger amount of toner is adhered to the carrier surface, the flux density passing through the carrier particles is as much reduced. When the toner concentration becomes lower than a constant value, a signal is input to a control unit (not illustrated) and the motor $M_3$ starts to rotate. Thereby, the toner supplying roller 13 and agitator 14 rotate and the toner in the toner hopper 18 is supplied to the stirring unit from a hole 12 provided at the internal wall of the case 9 by means of the sponge roller of toner supplying roller 13.

In this case, a cleaning means 17 provided to the toner supplying roller 13 rotates simultaneously to conduct the cleaning for the toner adhered to the detecting surface 15 of the toner detector 16. The detecting surface 15 projects within the hopper 18 and toner may be detected depending on the fact that toner is adhered to the surface of detecting surface 15 or not.

The toner is replenished to the toner hopper 18 from the toner cartridge 19, but when the toner in the toner cartridge 19 is used up and toner in the supply of toner hopper 18 becomes low, the toner around the detecting surface 15 is removed and after the surface of the detecting surface is cleaned, the toner is no longer adhered. Accordingly, the toner detector 16 sends the signal indicating "no-toner" condition to the controller to indicate replacement of toner cartridge 19 by a display, for example.

FIG. 2 is a diagram for explaining an example of a cleaning means. The detecting surface 15 of toner detector 16 is projected within the toner hopper 18. If the toner is continuously adhered to the surface, the toner is judged to be existing even after the toner in the toner hopper 18 becomes low, and replacement of toner cartridge 19 cannot be indicated. Therefore, in case a cleaning means 17 formed, for example, by the narrow rectangular type silicon rubber is attached to the shaft of toner supplying roller 13, when the toner supplying roller 13 rotates, the end part of the cleaning means 17 wipes the detecting surface 15 for the cleaning purpose.

The toner supplying roller 13 does not rotate continuously so long as the quantity of toner in the stirring unit is not too low and usually it makes only a single or half turn. In case the cleaning means 17 is in contact with the detecting surface 15 of toner detector 16, the toner detector 16 recognizes "existence of toner" and thereby if the toner does not remain in the toner hopper 18, judgement of "existence of toner" will be made erroneously.

In view of avoiding such erroneous determination, it is essential to detect the position where the cleaning means 17 is not in contact with the detecting surface 15 and to collect detected result of toner detector 16 in this case. Therefore, it is required to provide a position detecting means such as a photoencoder to the shaft of toner supplying roller 13 or to the shaft of motor $M_3$ and the control unit calculates the position where the cleaning means 17 is not in contact with the detecting surface 15 based on the position information detected by such position detecting means. Namely, it is recommended that the toner detection is preferably carried out while the cleaning means 17 is obviously not in the contact with the detecting surface 15.

As a result, a structure of the control unit is complicated and a problem rises here that the developing unit 4 becomes expensive since hardware such as a photoencoder is provided. Therefore, it has long been expected to propose a simplified method which further determine accurately existence of the toner.

Some references of the method in this technical viewpoint have been proposed. The Japanese Laid-open Patent No. 58-130366 [Application Date: Feb. 29, 1982, by S. Suda, Canon Inc.] proposes a structure under the condition that an output of a toner sensor does not change even when the stirring is conducted in the vicinity of the sensor of the toner hopper or when the sensor detecting surface is cleaned. This reference is different from the present invention. Moreover, it is also explained that the cleaning member stops on the sensor detecting surface, but an output of the toner sensor in this case is not explained.

The Japanese Laid-open Patent No. 58-70254 [Application Date: Oct. 23, 1981, by H. Takeda, M. Ishida, Canon Inc.] proposes a method wherein existence of toner is detected simply by duration time of toner sensor output. This reference is different in structure from the present invention which refers to duration time of toner sensor output within the toner supply time by the toner supplying roller. Therefore, when the toner removing member on the detecting surface stops on the sensor detecting surface, existence of toner is recognized without relation to existence of toner.

The Japanese Laid-open Patent No. 57-196274 [Application date: May 28, 1981, by M. Shibusawa, Ricoh] discloses a method where the detecting surface of a toner sensor is cleaned by a movable member once or more for every one cycle of developing (single page printing), cleaning is carried out between development in every page and position control is carried out so that the cleaning member is set to a determined position during the period other than the cleaning period. This reference is different from the present invention in purpose and structure.

SUMMARY OF THE INVENTION

It is an object of the present invention to provide an economical method of detecting toner of the developing unit.

It is another object of the present invention to accurately detect existence of toner.

Such objects may be attained by the following method. Namely, a method of detecting toner in which existence of toner is detected on the basis of the duration of a detected output of toner detector in the toner supplying period of a toner supplying roller.

The control unit which controls each motor, toner concentration sensor and toner detector associated with the developing unit is given the function to detect existence of toner. Namely, during rotation of the toner supplying roller, the duration of the transmitting signal indicating "existence of toner" is accumulated for the software timer which indicates operation of control unit. When the total duration is longer than a constant period determined by the rotating speed of the toner supplying roller, it is judged as "existence of toner". On the contrary, the transmitting duration of the signal indicating "no-existence of toner" is accumulated. When the total duration is longer than a constant period determined by the rotating speed of the toner supplying roller, it is judged as "no-existence of toner".

Thereby, the present invention does not require extra hardware to be added and ensures a method of detecting toner through simplified control of the control unit and not by means of an expensive developing unit.

BRIEF DESCRIPTION OF THE DRAWINGS

FIG. 3(*b*) is a conceptional view for explaining detection of toner using a timechart;

FIG. 4(*b*) is a block diagram indicating the control system of the embodiment of the present invention;

FIG. 5(*b*) is a timechart in case the processor recognizes "no-existence of toner" when the quantity of toner in a the toner hopper is reduced; and FIG. 5(*c*) is a timechart in case the processor recognizes "existence of toner" because sufficient amount of toner exists in the toner hopper.

DESCRIPTION OF THE PREFERRED EMBODIMENTS

An embodiment of the present invention will be explained by referring to FIGS. 3 to 5. The like numerals designate the like materials and elements in above drawings.

Figure 3B:
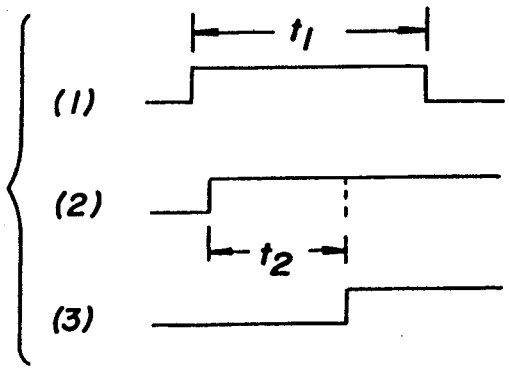
FIG. 3(*a*) is a schematic diagram of the necessary part of developing unit.
Figure 3A:
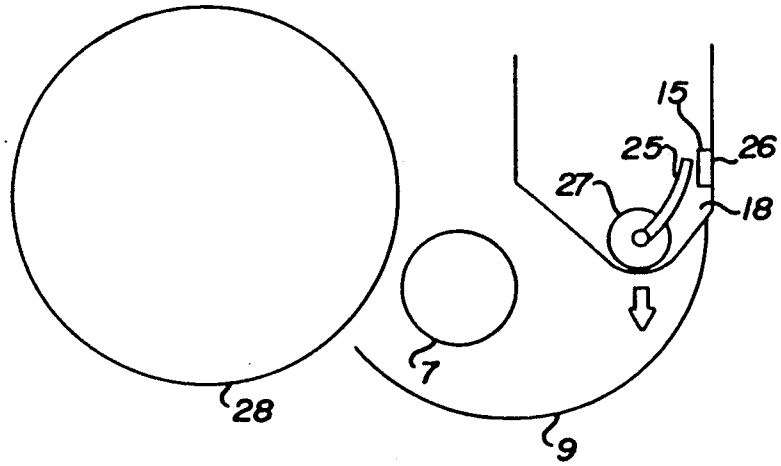

FIGS. 3(*a*),(*b*) are diagrams for explaining the principle of the present invention. FIG. 3(*a*) is a schematic diagram of the necessary part of a developing unit, comprising a case 9 providing a developing unit roller 7 for developing a latent image on the photosensitive drum 28, a toner supplying means 27 for supplying toner in the toner hopper 18 to the case 9, a toner detecting means 26 for detecting toner in the toner hopper 18 from the toner adhered to the detecting surface 15 and a cleaning means 25 for cleaning the toner adhered to the detecting surface 15 in conjunction with the toner supplying means 27.

FIG. 3(*b*) is a diagram for explaining an example for detecting the toner with reference to the timechart. The timechart (1) is an output timechart indicating that the toner supplying means 27 is in operation at the time $t_1$. As shown in timechart (2), when detected output of toner detecting means 26 continues for the predetermined time $t_2$ or longer, existence of toner is detected as shown in the detection timechart (3). Thereby, erroneous detection resulting from an output obtained when the cleaning means 25 comes into contact with the toner detecting means 26 and stops there can be prevented. (As will be explained later, while the toner supplying means 27 operates, the time wherein the cleaning means 25 is in contact with the toner detecting means 26 may be determined to be $t_2$ or less.)

Figure 4:
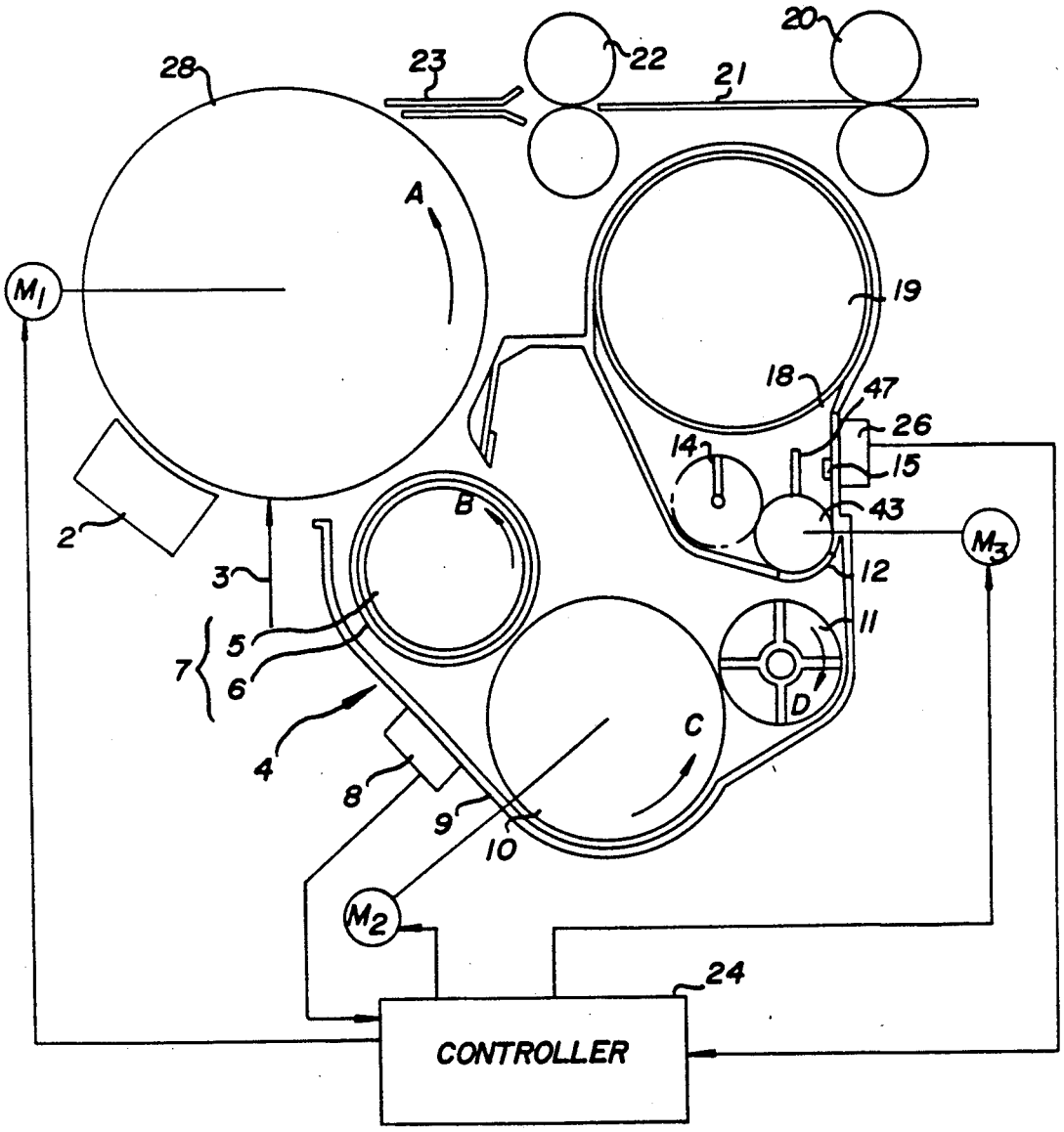
FIG. 4(*a*) is a total structure of this embodiment.
Figure 4B:
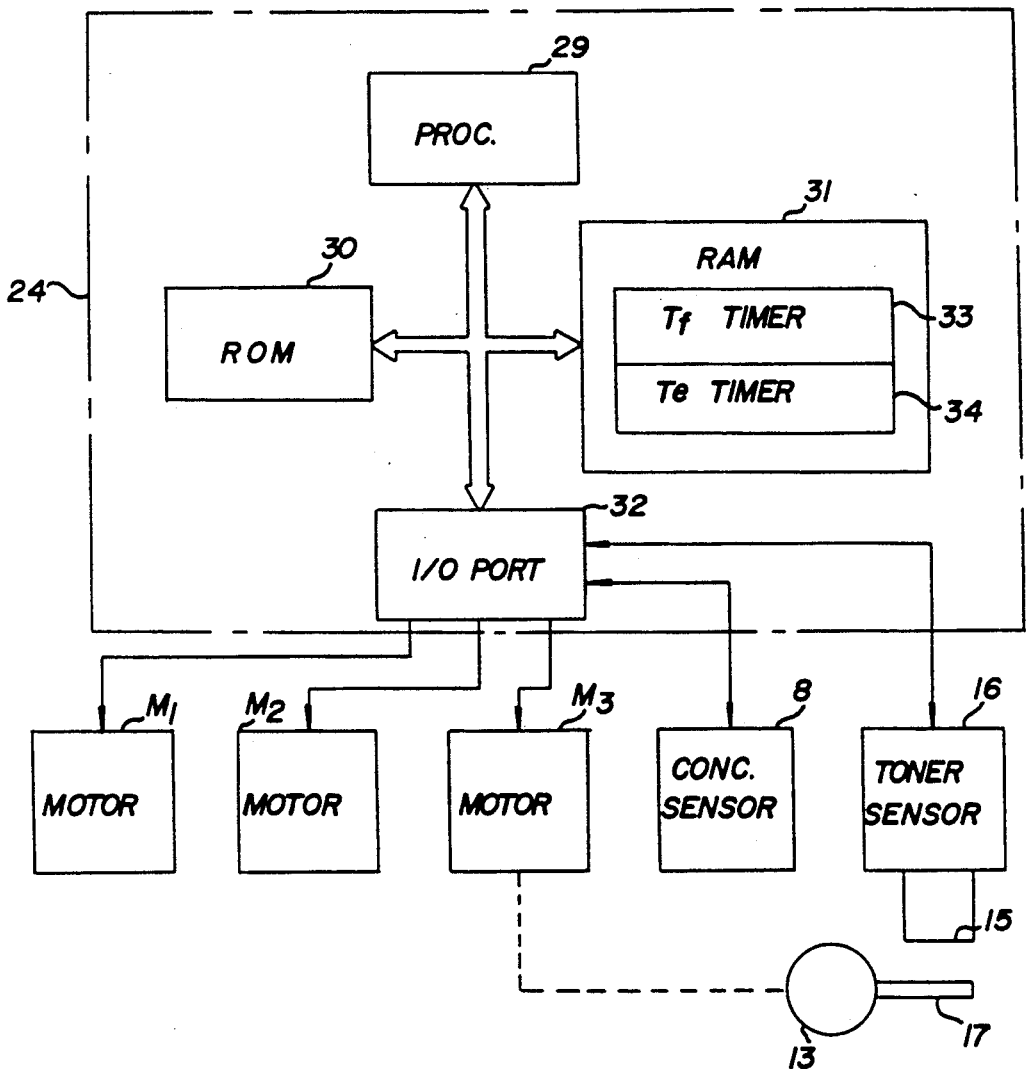

FIGS. 4(*a*) and (*b*) are diagrams for explaining an embodiment of the present invention.

Figure 1:
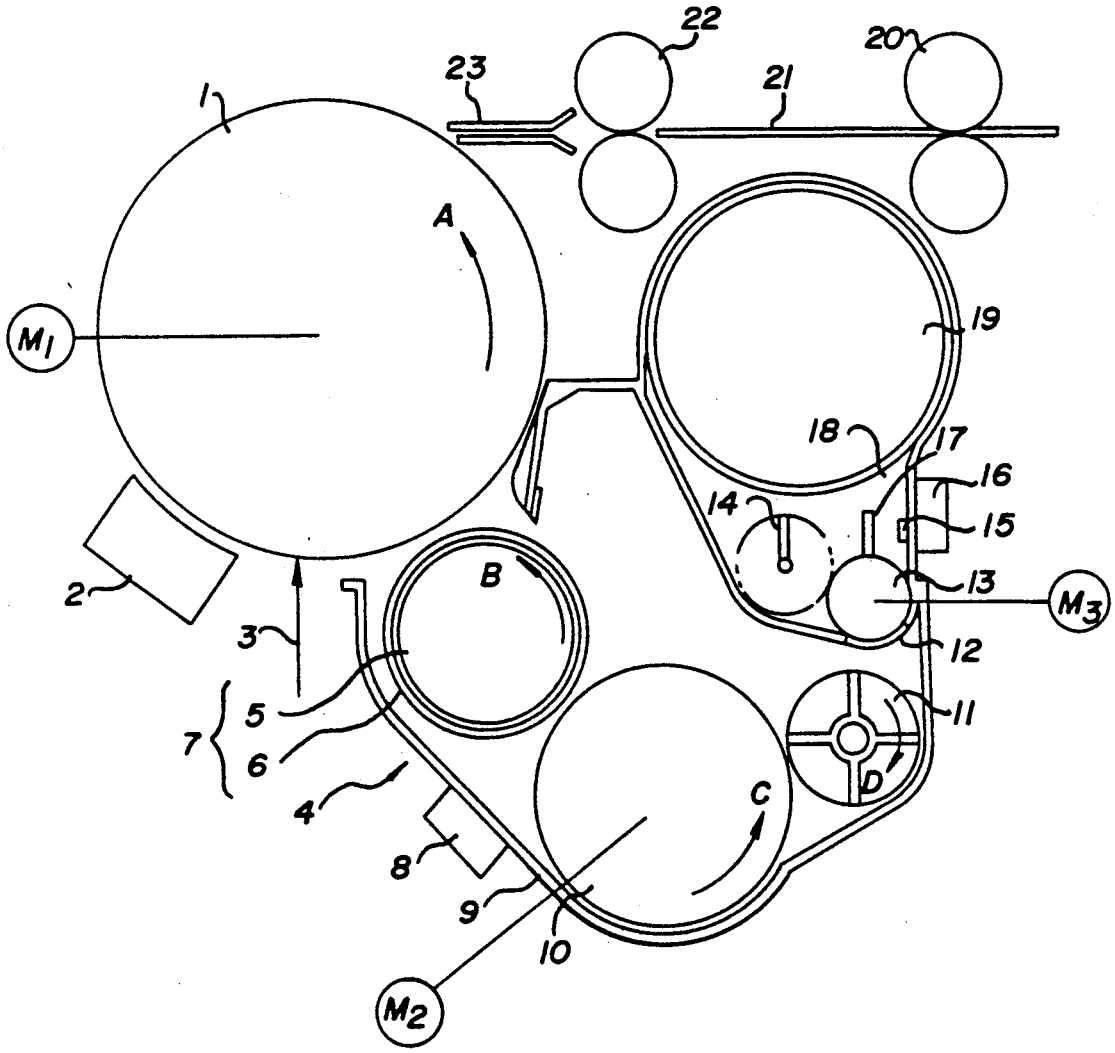
FIG. 1 PRIOR ART
FIG. 1 is a diagram for explaining an example of a developing unit of the prior art.
Figure 2:
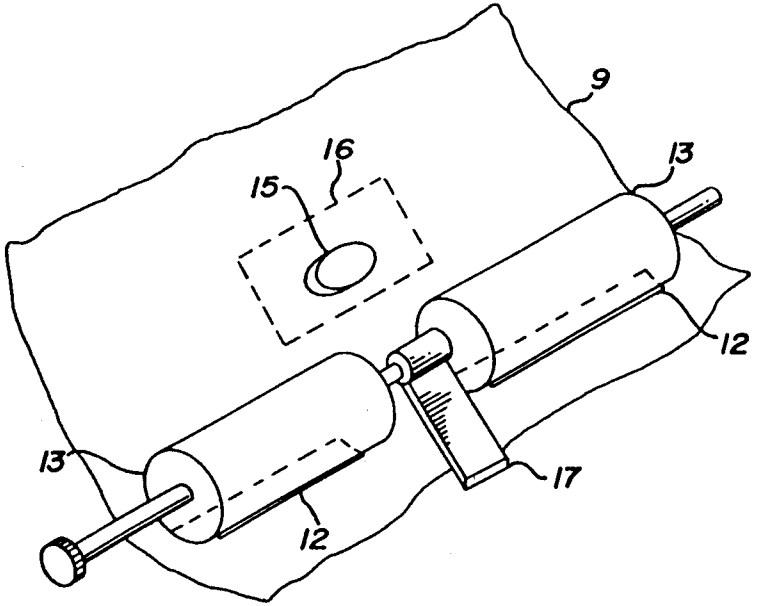
FIG. 2 PRIOR ART
FIG. 2 is a diagram for explaining an example of a cleaning means of the prior art.

FIG. 4(*a*) is a diagram indicating a total structure of the present invention. The part which is equivalent to that explained with reference to FIG. 1 is not explained here.

The concentration sensor 8 transmits a signal depending on change of permeability due to reduction in quantity of toner at the stirring unit. When the level of output signal of concentration sensor 8 exceeds a predetermined value due to reduction of toner concentration, the control means 24 drives the motor $M_3$ to rotate the toner supplying roller 43 of the toner supplying unit. The cleaning means 47 attached to the rotating shaft of the toner supplying roller 43 rotates with the toner supplying roller 43 in order to remove the toner adhered to the detecting surface 15 of toner detector 26 for the detecting surface 15 cleaning purpose.

The toner detector used in this embodiment is TS15D20-17A, TDK, which can be commercially available and is designed as a vibration type remaining toner detector. The single surface of a thin disk type ceramic plate having electrodes in both surfaces thereof is used as the toner detecting surface and allows formation of an oscillation circuit. Whenever the toner is adhered to the detecting surface or whenever cleaning means comes in contact therewith and stops there, oscillation stops for the recognition purpose.

The control means 24 detects existence or non-existence of toner based on the duration of the signals indicating "existence of toner" and/or "no-existence of toner" issued from the toner detector 26 while the toner supplying means 47 rotates, namely, while a drive current is supplied to the motor $M_3$.

Namely, only while the motor $M_3$ is driven, the control means 24 accumulates the transmission time of the signal indicating "existence of toner" from the toner detector 26 by using of the timer function by software. In case the signal "existence of toner" continues longer than a constant time predetermined by the rotating speed of the toner supplying means 47, the "existence of toner" condition is truly detected because the transmission time of the signal "existence of toner" is indicated during the period wherein the cleaning means 47 is not in contact with the detecting surface 15.

In case the transmission time of the signal indicating "no-existence of toner" from the toner detector 26 is accumulated and the signal "no-existence of toner" continues longer than a constant time predetermined by the rotating speed of the toner supplying means 47, the "no-existence of toner" is truly detected because the transmission time of "no-existence of toner" is indicated during the period wherein the cleaning means 47 is not in contact with the detecting surface 15.

Therefore, the control means 24 detects existence or no-existence of toner depending on any one result or both results.

FIG. 4(*b*) is a block diagram indicating the control system of this embodiment. In FIG. 4(*b*), the processor 26 reads and operates a program stored in ROM 30 and controls a drive circuit (not illustrated) through an input/output port 32 to supply a drive current to motors $M_1$, $M_2$ and rotate the photosensitive drum 1 and agitation roller 10, respectively.

The processor 29 controls, upon input of the signal indicating replenishment of toner from the concentration sensor 8 through the input/output port 32, a drive circuit (not illustrated) through the input/output port 32 to supply a drive current to the motor $M_3$ and rotate the toner supplying roller 43. Accordingly, the cleaning means 47 also rotates with the toner supplying roller 43 and removes the toner adhered to the detecting surface 15 of the toner detector 26.

Next, continuous supply of toner to the stirring unit will be explained with reference to the timecharts indicated in FIGS. 5(*a*), 5(*b*), 5(*c*).

Figure 5C:
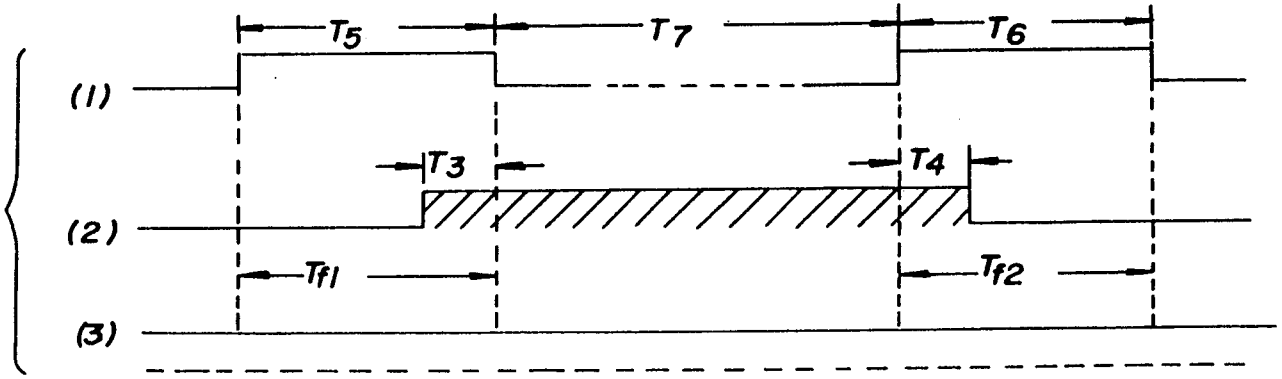
FIG. 5(*a*) is a timechart for explaining change of toner detector output for a small quantity of toner in the hopper and for a large quantity thereof in case the toner supplying roller turns three times.
Figure 5A:
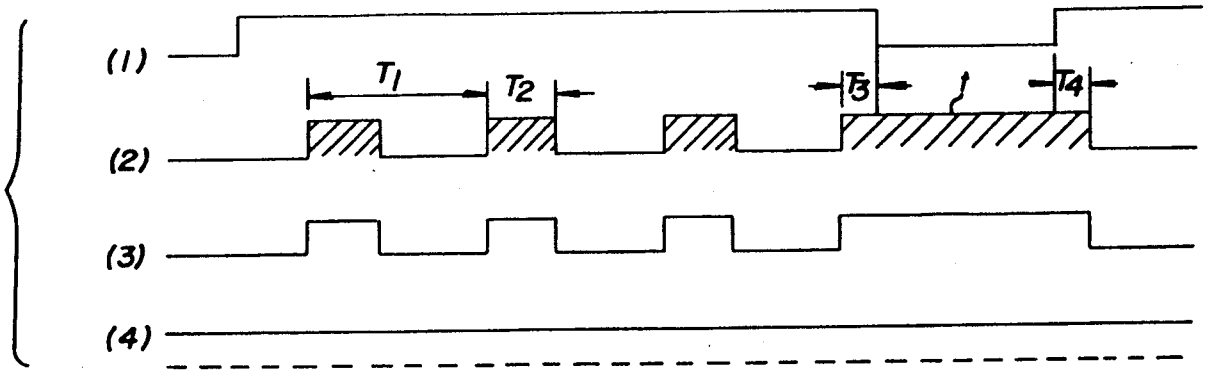
Figure 5B:
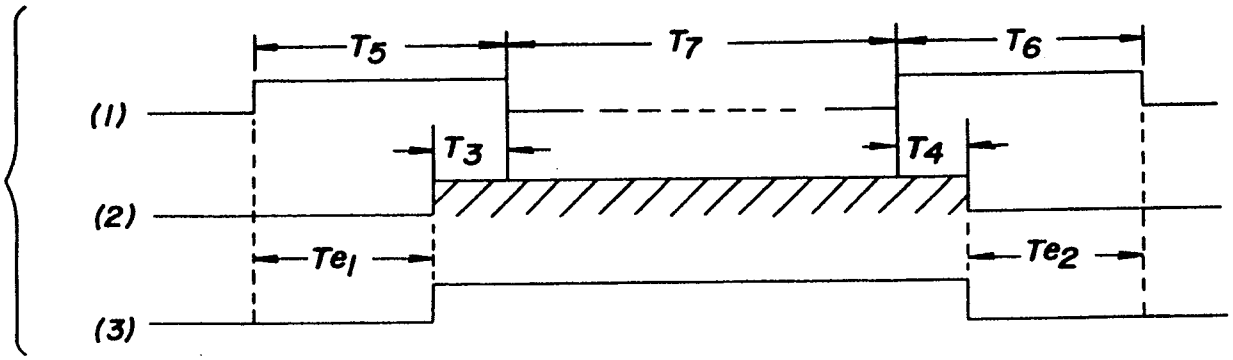

The upper most timechart (1) of FIG. 5(*a*) indicates the timechart of a drive current of motor $M_3$ driven by the processor 29 of FIG. 4(*b*). The toner supplying roller 43 rotates depending on rotation of the motor $M_3$ and thereby the cleaning means 47 fixed to the rotating shaft of toner supplying roller 43 also rotates. While the cleaning means 47 rotates, the cleaning means 47 comes to contact with the detecting surface 15 of toner detector 26 to remove the toner on the detecting surface 15. This process is shown in the timechart (2). $T_1$ indicates the time required for single turn of the toner supplying roller 43 or cleaning means 47 and the cleaning means 47 comes into contact with the detecting surface 15 during the time $T_2$ of the time $T_1$. In the timechart (2), the cleaning means 47 comes into contact with the detecting surface 15 for the time $T_3$ and stops there until the motor $M_3$ turns for three times and stops. After the time t, the motor $M_3$ starts to drive the cleaning means and it is perfectly separated from the detecting surface 15 after the time $t_4$ from the starting of drive. In this case, a sum of times $T_3$ and $T_4$ is considered to be equal to the time $T_2$. Namely, $T_2=T_3+T_4$, because $T_1$ is usually almost equal to 2 sec and $T_2$, to 0.8 sec and therefore an error of time based on the change of speed due to start/stop of motor $M_3$ is small enough to be neglected.

In case the quantity of toner in the toner hopper 18 is comparatively small, an output signal of the toner detector 26 shown in the timechart (3) is sent to the processor 29. Namely, the cleaning means 47 issues a signal indicating "existence of toner" only while the cleaning means 47 is in contact with the detecting surface 15 or a signal indicating "no-existence of toner" while it is separated from the detecting surface 15.

In case the quantity of toner in the toner hopper 18 is large, the toner detector 26 continuously issues the signal "existence of toner", as shown in the timechart (4), not only during the time cleaning means 47 is in contact with the detecting surface 15 but during the time it is separated therefrom, since the toner is constantly in contact with the detecting surface 15.

When the concentration sensor 8 stops transmission of signal which indicates need for replenishment of toner as a result of replenishment of toner to the toner stirring unit, the processor 29 stops driving of the motor $M_3$. Therefore, rotation of toner supplying roller 43 also stops. However, as shown in time t of timechart (2), if the cleaning means 47 remains in contact with the detecting surface 15 until the motor $M_3$ is driven again, the toner detector 26 continuously issues the signal "existence of toner" even in case the supply of toner in the hopper is low. Accordingly, when operation is carried out in such a timing, the "no-existence of toner" condition must be detected certainly.

FIG. 5(*b*) indicates a timechart in case the processor 29 recognizes the condition of "no-existence of toner" because the quantity of toner in the toner hopper 18 becomes low When the processor 29 drives the motor $M_3$, it causes start of accumulation of time by starting the $T_f$ timer 33 and $T_e$ timer 34 with the software provided to RAM 31 shown in FIG. 4(*b*). Here, the $T_f$ timer 33 accumulates the time where the toner detector 26 issues the signal "existence of toner" only during the time processor 29 supplies a drive current to the motor $M_3$. On the other hand, the $T_e$ timer 34 accumulates the time where the toner detector 26 issues the signal "no-existence of toner" only during the time processor 29 supplies a drive current to the motor $M_3$.

The processor 29 resets the $T_e$ timer 34 when the $T_f$ timer 33 accumulates the time for detecting the signal "existence of toner" and also resets the $T_f$ timer 33 when the toner detector 26 accumulates the time for sending the signal "no-existence of toner" during the time drive current is supplied to the motor $M_3$.

Therefore, as shown in the timechart (1) of FIG. 5(*b*), the $T_e$ timer 34 accumulates the times $T_{e1}$ and $T_{e2}$ shown in the timechart (3) between the times $T_5$ and $T_6$ for causing a single turn of the toner supplying roller by supplying a drive current to the motor $M_3$. A sum of $T_5$ and $T_6$ is equal to the time $T_1$ for single turn and is about 2 sec as explained previously. $T_7$ indicates the time until the next replenishment of toner after the time $T_5$. The $T_f$ timer 33 accumulates the times $T_3$ and $T_4$ shown in the timechart (2).

The timechart (2) of FIG. 5(*b*) indicates the condition that the cleaning means 47 is in contact with the detecting surface 15. A sum of the time $T_3$ until the motor $M_3$ stops from contact of cleaning means 47 with the detecting surface 15 and the time $T_4$ until separation of cleaning means 47 from the detecting surface 15 from start of driving by the motor $M_3$ is equal to $T_2$, namely is 0.8 sec. Therefore, the accumulation time ($T_{e1}+T_{e2}$) by the $T_e$ timer 34 is expressed as follow.

$$T_{e1}+T_{e2}=(T_5+T_6)-(T_3+T_4)=1.2 \text{ sec.}$$

Accordingly, when the time accumulated by the $T_e$ timer 34 is 1 sec or longer including an error due to mechanical operation, the processor 29 determines the condition of "no-existence of toner".

In this case, a "no-existence of toner" condition is informed to an operator by a certain method, for example, letters are displayed on the operator panel, or display lamps are flickered or voice message "replenish the toner, please" is output.

FIG. 5(*c*) is a timechart of conditions causing the processor 29 to recognize the "existence of toner" condition because sufficient amount of toner exists in the toner hopper 18.

The processor 29 starts, when a drive current is supplied to the motor $M_3$, the $T_f$ timer 33 and $T_e$ timer 34 by the software provided to RAM 31. The $T_f$ timer 33 starts accumulation of time since the toner detector 26 issues the signal indicating "existence of toner". The $T_e$ timer 34 does not accumulate time since the toner detector 26 does not issue the signal indicating "no-existence of toner". Since reset carried out when the $T_f$ timer 33 completes accumulation of the "existence of toner" time, when the toner detector 26 sends the "no-existence of toner" signal, the $T_e$ timer 34 starts accumulation from zero.

While the processor 29 supplies a drive current to the motor $M_3$, namely only during the periods $T_5$ and $T_6$ of timechart (1), the $T_f$ timer 33 accumulates the time where the toner detector 26 issues the signal indicating "existence of toner", namely the times $T_{f1}$, $T_{f2}$ of timechart (3).

As will be understood from the timecharts (1), (3), $T_{f1}+T_{f2}=T_5+T_6\sim 2$ sec. Therefore, when the time ($T_{f1}+T_{f2}$) accumulated by the $T_f$ timer 33 is longer than the time decided as "existence of toner", for example, 2 sec or longer, the processor 29 decides "existence of toner".

As explained above, the processor 29 can accurately detect existence or no-existence of toner from any one of the accumulation times by the $T_f$ timer 33 or $T_e$ timer 34 or from both accumulation times.

What is claimed is:

1. A method of detecting toner in a toner supplying unit of a developing unit provided to develop a latent image formed on an image carrier with the toner, wherein said toner supplying unit includes a toner detector having a toner detecting surface in contact with toner therein, a toner supplying roller driven by a motor, and a detecting surface cleaning means fixed to a rotating shaft of said toner supplying roller and rotating therewith to remove toner from the detecting surface, said method comprising the steps of:

detecting toner concentration in a stirring unit of said developing unit with a concentration sensor;

controlling drive of said toner supplying roller for supplying toner to said stirring unit from the toner supplying unit by means of a control unit, based on an output signal from said concentration sensor;

generating any one of signals indicating "existence of toner" and "no-existence of toner" within the toner supplying time by the toner detector for determining a remaining amount of toner in said toner supplying unit;

accumulating duration times of said signals indicating "existence of toner" and "no-existence of toner" generated by the toner detector within said toner supplying times in the control unit; and detecting one of an "existence of toner" and "no-existence of toner" condition based on the duration of times of said toner detector output signals accumulated by the control unit within said toner supplying time.

2. A method of detecting toner according to claim 1, wherein a "no-existence of toner" condition is detected when a total sum of duration of "no-existence of toner" signal time accumulated is longer than a first time predetermined in relation to time of a single rotation of said toner supplying roller.

3. A method of detecting toner according to claim 1, wherein an "existence of toner" condition is detected when a total sum of time duration of an "existence of toner" signal accumulated is longer than a second time predetermined in relation to time of a single rotation of said toner supplying roller.

4. A method of detecting toner according to claim 2, wherein said first time is equal to the time obtained by subtracting an error time due to mechanical operation from the time difference between the time required for a single turn by said toner supplying roller and the time required for passing over the toner detecting surface by said cleaning means.

5. A method of detecting toner according to claim 3, wherein said second time is equal to the time required for a single turn by said toner supplying roller.

6. A method of detecting toner according to claim 1, wherein said method further comprises the steps of displaying existence or no-existence of toner in said toner supplying unit based on the detection of existence or no-existence of toner.

7. A toner detector for detecting remaining toner, to be used for replenishment of toner consumed, in accordance with an output signal of a toner concentration sensor in a developing unit provided to develop a latent image on an image carrier with the toner, said toner detector comprising:

a toner hopper for temporarily storing the toner to be replenished by a toner cartridge;

a toner detecting means for detecting presence of toner in said toner hopper including a toner detecting surface within said hopper;

a toner cleaning member for cleaning the detecting surface of said toner detecting means by removing toner therefrom;

a developing unit including a stirring unit to provide a developer by mixing the toner and a carrier, and a developing roller to supply the developer to an image carrier;

a toner supplying roller provided within said toner hopper to supply the toner in the hopper to the stirring unit by rotation thereof, said toner cleaning member being fixed to a rotating shaft of said toner supplying roller; and a control means for detecting toner in the toner hopper from duration of at least one of signals indicating "existence of toner" and "no-existence of toner" sent from said toner detecting means within the toner supplying time in which the toner supplying roller supplies toner to the developing unit.

8. A toner detector for detecting toner according to claim 7, wherein said control means further comprises:

a processor for controlling rotation of the toner supplying roller and the cleaning means which rotates therewith in accordance with an instruction issued from a toner concentration sensor in the developing unit;

a first timer for accumulating duration of a signal indicating "no-existence of toner" sent from the toner detecting means within the time said processor rotates said toner supplying roller; and a second timer for accumulating duration of a signal indicating "existence of toner" sent from the toner detecting means within the time said processor rotates said toner supplying roller.

* * * * *